US005194840A

United States Patent [19]

Frutuoso et al.

[11] Patent Number: 5,194,840

[45] Date of Patent: Mar. 16, 1993

[54] CIRCUIT BREAKER PHASE CURRENT BARRIER

[75] Inventors: Louis M. Frutuoso, Newington; Louis A. Rosen, Hartford; Timothy W. Webber, Bristol, all of Conn.

[73] Assignee: General Electric Company, New York, N.Y.

[21] Appl. No.: 872,195

[22] Filed: Apr. 22, 1992

[51] Int. Cl.[5] ..... H01H 9/02

[52] U.S. Cl. ..... 335/202; 335/132

[58] Field of Search ..... 335/8-10, 335/131-132, 202, 201; 200/144 R, 147 R

[56] References Cited

U.S. PATENT DOCUMENTS 4,754,162 6/1988 Kondou et al. ..... 335/8
4,963,849 10/1990 Kowalczyk et al. ..... 335/201
5,005,104 4/1991 Grunert et al. ..... 335/202

*Primary Examiner*—Lincoln Donovan
*Attorney, Agent, or Firm*—Richard A. Menelly

[57] ABSTRACT

An industrial rated molded case circuit breaker is fitted with a phase barrier and a phase insulation cap at the line end thereof to redirect the arc exhaust gases exiting from the line end and to prevent an electric circuit between the different phases of a multiphase electric power distribution system. The Y-shaped phase barrier eliminates the need to provide additional insulation to the line end conductors. The phase insulation cap provides inexpensive and reusable means for isolating mounting screws from the line end conductors.

9 Claims, 3 Drawing Sheets

CIRCUIT BREAKER PHASE CURRENT BARRIER

BACKGROUND OF THE INVENTION

A conventional multiphase circuit breaker generates ionized gases within each phase of the circuit breaker during the circuit interrupt condition. Modern circuit breaker designs are more compact and generate additional power in smaller spaces than conventional circuit breakers. Due to the reduction of internal space and the increased power generation, the gases produced are more intense and are at higher temperatures. When a compact current limiting circuit breaker, such as described in U.S. Pat. No. 4,963,849 entitled "Compact Current Limiting Circuit Breakers" is used within an industrial power distribution circuit, intense arc gases are generated during overcurrent circuit interruption. These high temperature gases must exit the circuit breaker enclosure in order to prevent the circuit breaker enclosure from becoming over-stressed. Ventilated circuit breakers provide openings within the circuit breaker enclosure to allow the ionized gas to exit the circuit breaker in a controlled manner.

The U.S. patent application No. 07/736,673, filed Jul. 26, 1991, entitled "Molded Case Circuit Breaker Arc Exhaust Gas Controller" describes one means for controlling the egress of gases from the circuit breaker enclosure. The arc gases exiting through the ventilation slot of one line terminal compartment must be prevented from contacting a line terminal connector within an adjacent line terminal compartment to prevent a so-called "phase-to-phase" fault. The typical approach to prevent the occurrence of short circuit between the line end conductors of different phases is to tape each conductor with insulating tape. This practice is labor intensive and expensive.

The U.S. patent application No. 07/836,573, filed Feb. 18, 1992, entitled "Arc-Proof Molded Case Circuit Breaker" describes one means of decreasing the intensity of the exiting arc exhaust gases so that the connecting busbars need not be separately shielded. Some means must be employed to prevent the ionized gases from contacting the associated grounded enclosure to thereby prevent the occurrence of a so-called "phase-to-ground" fault. Fasteners, such as screws, which secure the circuit breaker to the power take-off enclosure are in close proximity with the line end conductors. The high current passing through these conductors may arc across and cause a short circuit. The problem is often addressed by applying insulating epoxy to isolate the screws, a costly practice which requires additional space. Applying such epoxy, frequently called "potting," becomes problematic when the assembly must be disassembled and the operator must access the screws.

One purpose of this invention is to redirect gases exiting from the circuit breaker phases and to isolate conductors of adjacent phases from each other to avoid short circuits without requiring taping of the conducting connectors that are attached to the circuit breaker.

Another purpose of the invention is to isolate the circuit breaker mounting screws to prevent the occurrence of short circuits between the screws and the conductors within the power take-off assembly.

SUMMARY OF THE INVENTION

The invention comprises a line end phase barrier and phase insulation caps. The line end phase barrier consists of a Y-shaped plastic barrier arranged over the line end of the circuit breaker so that arc gases generated within each phase of the circuit breaker are redirected away from each other. The barrier also separates line end conducting means of one phase from those of an adjacent phase so that phase-to-phase fault occurrence is prevented. The phase insulation caps are placed over the mounting screws disposed between the circuit breaker phases in close proximity to line terminals so that the current is prevented from transferring to the mounting screws.

DESCRIPTION OF THE PREFERRED EMBODIMENT

Figure 3:
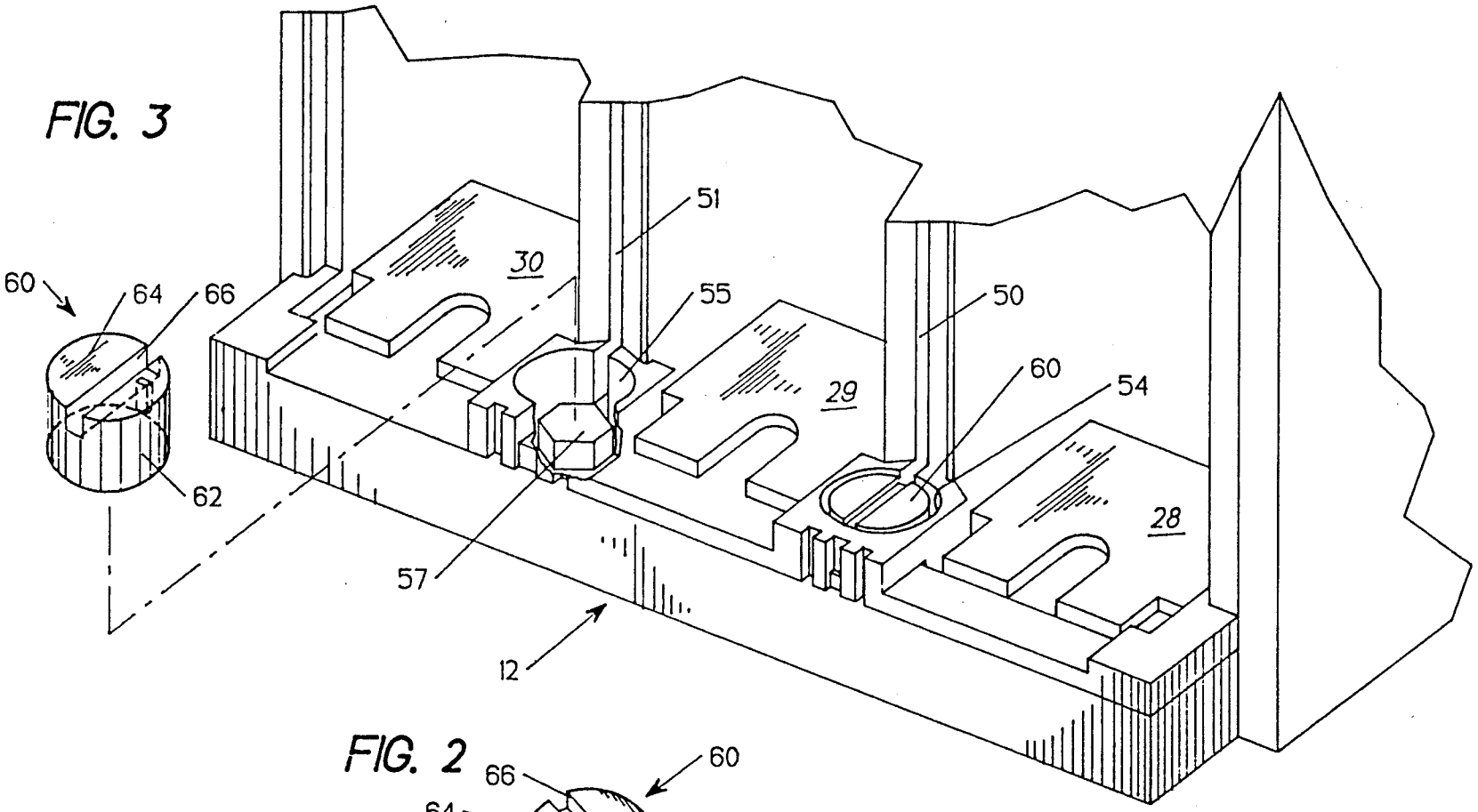
FIG. 3 is a top perspective view of a portion of the circuit breaker of FIG. 1 with the phase insulation cap mounted thereon.

A power distribution system consists of a plurality of busbars supplying electricity through multiple connectors to circuit breakers located within the power take-off assembly that is attached to the busbars. One such power take-off assembly is a metal box enclosure that includes a subassembly 10, shown in FIG. 1, consisting of a multi-phase circuit breaker 12 which provides the power via wire connectors to associated equipment (not shown). A stab base assembly 14 supports stabs 16, 18 which are clamped onto the busbars (not shown) on one end and secured onto conducting connectors 20 on the other end and phase straps 23, 24 in turn connected to line straps 28–30 each corresponding to a phase of the circuit breaker 12. The line straps 28–30 (FIG. 3), disposed on a line end 34 of the circuit breaker 12, are integrally connected to an operating mechanism contained within the circuit breaker. The ventilated circuit breaker 12 consists of a molded plastic case 36 and a molded plastic cover 38 forming an enclosure 46 which includes elongated slots 50, 51 disposed on the line end portion 34 thereof, and positioned centrally between the phases. Each phase of a circuit breaker includes ventilation slots 40–42 disposed within the circuit breaker cover 38. As best seen in FIG. 3, mounting holes 54, 55 positioned directly below the slots 50, 51 accommodate screws 57 securing the circuit breaker to the power take-off enclosure.

Figure 2:
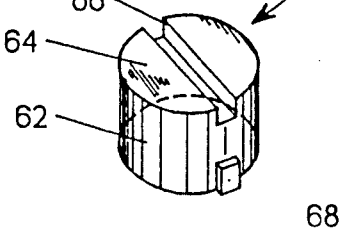
FIG. 2 is an enlarged top perspective view of the phase insulation cap in accordance with the invention.

FIG. 2 depicts a phase insulation cap 60 having a hollow cylindrical body 62 with one side closed to form a top portion 64 thereof. The cap 60 further consists of a substantially rectangular groove 66 formed within the top portion and extending across the surface thereof. A location tab 68 disposed on the cylindrical body 62 directly below one end of groove 66 has a substantially rectangular shape protruding radially outward.

As depicted in FIG. 3, the cap 60 fits into the mounting holes 54, 55 over the screws so that the locating tab 68 fits into the bottom of the elongated slots 50, 51, thus securing the cap in place. The locating tab ensures proper alignment of the cap within the mounting hole so that the groove 66 is oriented in parallel direction with the elongated slots 50, 51 within the circuit breaker 12. The cap isolates the screws 57 located within the mounting holes 54, 55 from the current carrying straps and line straps which are in close proximity thereto to prevent the occurrence of current transferring to the screws and causing an external short circuit condition. The cap is molded from an insulating-type plastic to provide reusable means of electrically isolating the screws.

Figure 1:
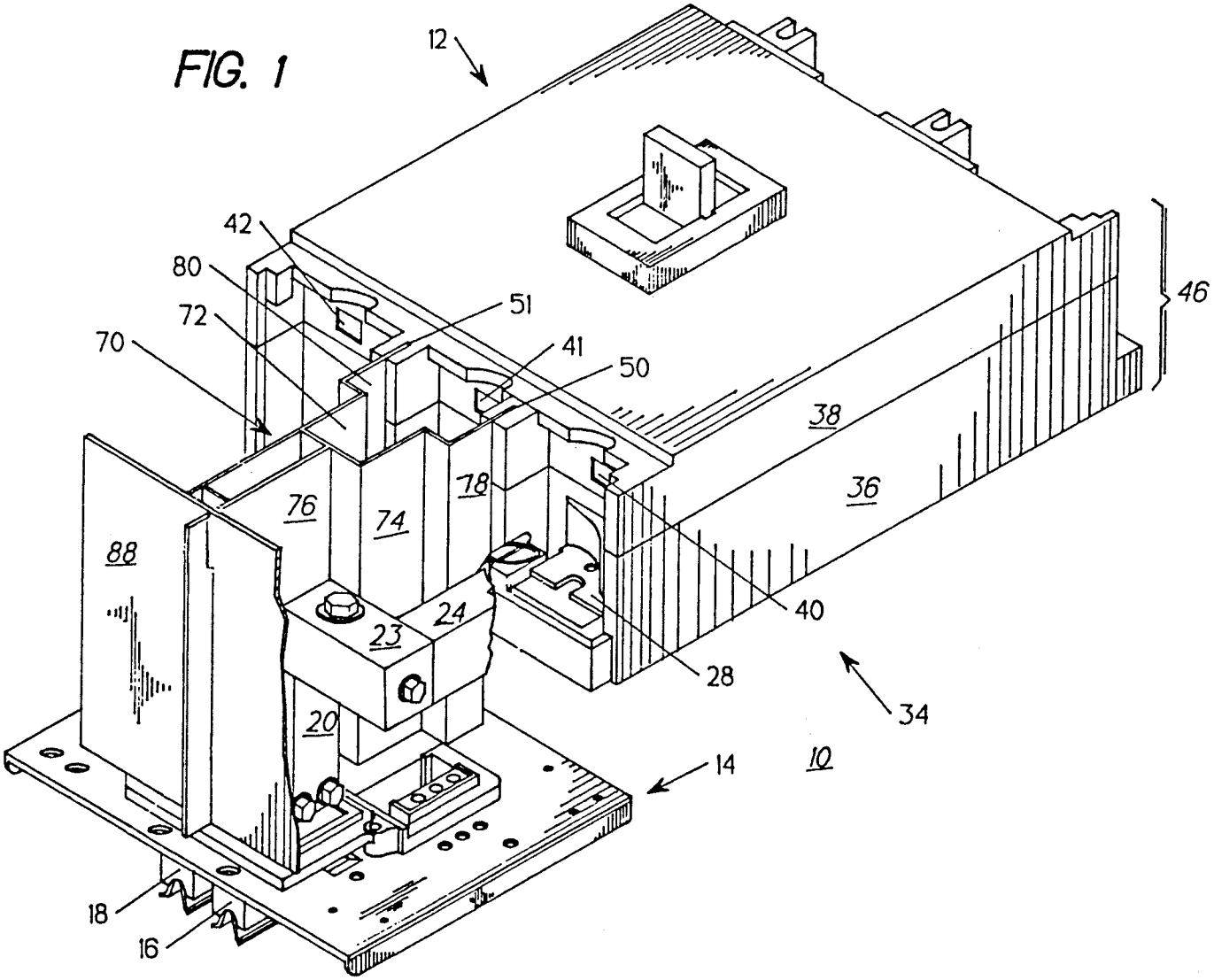
FIG. 1 is a top perspective cut-away view of a circuit breaker and a stab base subassembly employing one embodiment of the phase barrier and phase insulation cap in accordance with the invention.
Figure 4:
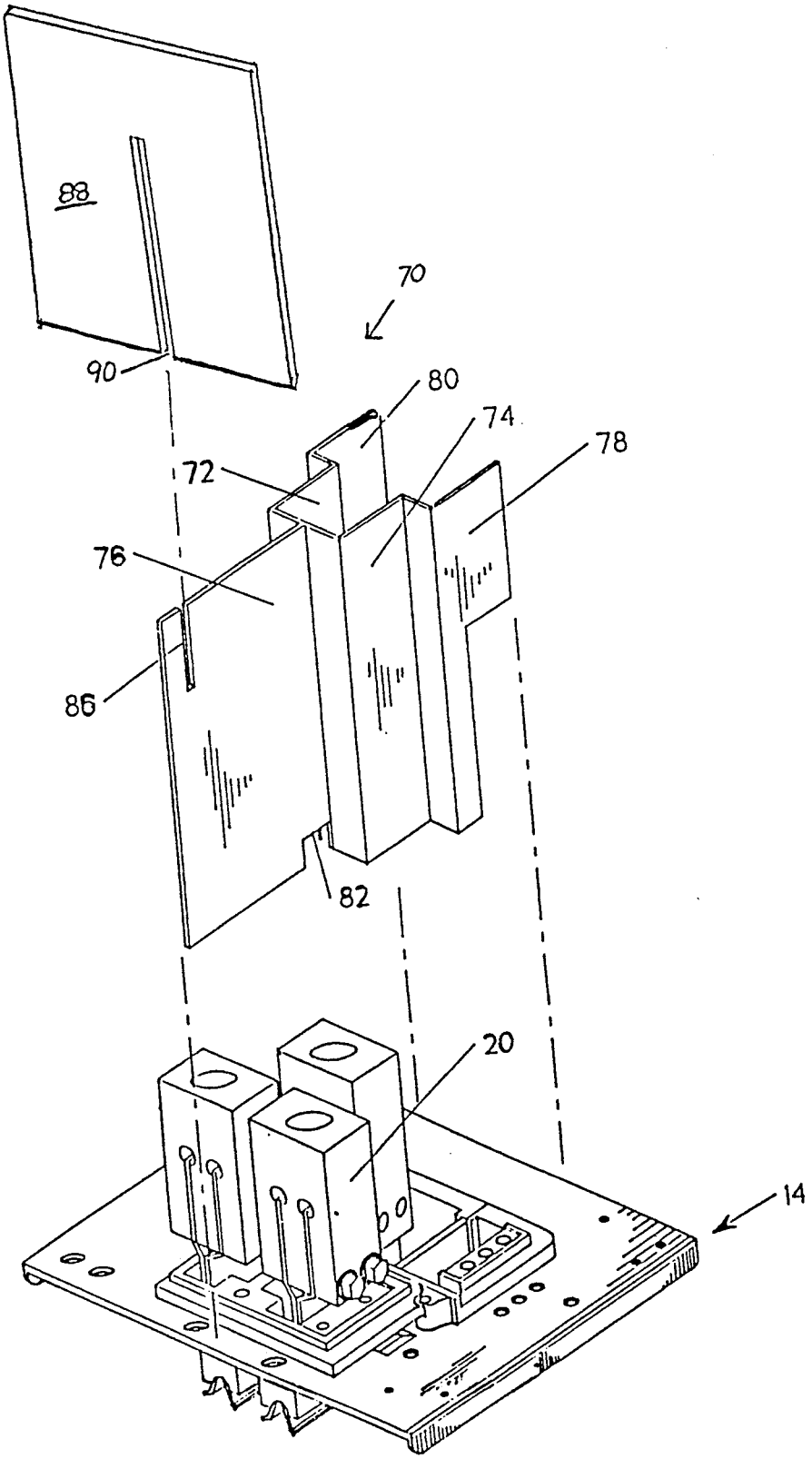
FIG. 4 is an exploded top perspective view of the phase barrier and the stab base subassembly of FIG. 1.

A phase barrier 70, as shown in FIGS. 1 and 4, consists of two substantially symmetrical wall portions 72,74, each having a stepped wall shape oriented in a mirror-like fashion and with bottom steps fastened together to form a base section 76 for an overall Y-shaped assembly. The top step portion of each stepped wall portion has a flange 78, 80 extending forward. The stepped shape of the barrier 70 facilitates insertion onto the stab base 14. The flanges 78, 80 of the barrier slide into the elongated slots 50, 51 of the circuit breaker and are fitted into the grooves 66 of the phase cap 60 (FIG. 3). The stepped wall portions 72,74 and the base 76 are sandwiched between the connectors 20 and are positioned onto the stab base 14 so that the base portion 76 separates the individual connectors from each other and the individual phase straps 23 from each other. The shape of the walls 72, 74 is wholly governed by the geometry and arrangement of the connectors and phase straps on the stab base. A notch 82 (shown in FIG. 4) disposed on the bottom edge of the base portion 76 of the barrier 70 fits into the stab base 14 and ensures alignment within the stab base and eliminates the need for fastening means and expensive assembly.

An elongated slit 86 disposed on an open end of the base portion of the barrier facilitates the insertion of a wall insulator 88 in an interlocking manner as shown in FIG. 1 to prevent electricity from passing from the conductors to the metal enclosure of the power take-off assembly situated in close proximity. The wall insulator 88 is a flat plastic piece with a corresponding slit 90 on the bottom portion thereof. The wall insulator slides onto the barrier so that the slits 86, 90 intermesh.

During the interrupt condition of the circuit breaker 12, arc gases are generated within each of the separate phases of the circuit breaker and are exhausted through the ventilating slots 40–42. The barrier 70 separates exhaust gases exiting from the different ventilating slots from contacting the connectors 20 and straps 23 of the different phases. Accordingly, the arc gases from one phase are prevented from coming into contact with the connectors of a different phase thereby preventing a short circuit. The gases exhausting from the center phase ventilating slot 41 remain in the middle compartment, formed by the barrier walls, wherein they become cooled and de-ionized. The barrier also eliminates the need to cover the connectors with insulating material. The preferred embodiment is fabricated from sheet-laminated phenolic resin such as Lexan which is a trademark of GE Company, although other insulating plastic materials can also be employed.

Having thus described our invention, what we claim and desire to secure by Letters Patent is:

1. A phase current barrier for molded case circuit breakers comprising in combination:

an electrically-insulated base;

a pair of electrically-insulated walls joined to said base and extending co-planar therewith; and a pair of off-set flanges extending from said walls, said flanges adapted for attachment to one end of a molded case circuit breaker, said base, walls and flanges being integrally-formed in a single unit, said flanges comprising edges coextensive with corresponding slots formed within outer extensions of a molded case circuit breaker enclosure, said edges being arranged for press-fit attachment within said coextensive slots.

2. The barrier of claim 1 including a pair of insulative caps, having transverse slot formed on one end, said caps being received within circular recesses formed at one end of a molded case circuit breaker enclosure.

3. The barrier of claim 2 including a tab extending from an opposite end of said caps, said tab being received within a bottom part of said corresponding slots.

4. The barrier of claim 2 wherein said flanges include an angulated bottom part, one edge of said bottom part being received within said transverse slot, thereby retaining said flanges against one end of a circuit breaker enclosure.

5. A molded case circuit breaker having increased circuit interruption capacity comprising, in combination:

a plastic case and cover securely fastened together to form a circuit breaker enclosure, said cover including exhaust ports situated at one end of said enclosure;

a pair of linear extensions formed on said one end and having a linear slot defined within an outer edge of said extensions; and a unitary gas manifold attached to said one end, said manifold including a pair of flanges extending from a pair of parallel walls, a front edge of said flanges being retained within said linear slot positioning said walls intermediate to an exterior of said exhaust ports;

whereby exhaust gases exiting from one of said exhaust ports are prevented from intermixing with exhaust gases exiting from an adjacent one of said exhaust ports.

6. The molded case circuit breaker of claim 5 including a pair of circular recessions formed within said case subjacent said linear extensions said recessions adapted for receiving means fastening said enclosure to a support.

7. The molded case circuit breaker of claim 6 including a support cap arranged within at least one of said recesses, said cap having a transverse slot formed on a top surface.

8. The molded case circuit breaker of claim 7 wherein a bottom edge of said flanges is received within said transverse slot for further retaining said manifold to said circuit breaker enclosure.

9. The molded case circuit breaker of claim 8 including a tab extending from a bottom surface of said cap, said tab being retained within a bottom part of said linear slot for retaining said cap on said circuit breaker enclosure.

* * * * *